United States Patent [19]

Goodwin

[11] Patent Number: 4,637,083

[45] Date of Patent: Jan. 20, 1987

[54] FLUIDIZED PATIENT SUPPORT APPARATUS

[75] Inventor: Vernon L. Goodwin, Charlotte, N.C.

[73] Assignee: Support Systems International, Inc., Charleston, S.C.

[21] Appl. No.: 711,246

[22] Filed: Mar. 13, 1985

[51] Int. Cl.[4] ..... A47C 27/08

[52] U.S. Cl. ..... 5/453; 5/449; 128/33

[58] Field of Search ..... 5/423, 449, 453–456, 5/461, 469; 128/33

[56] References Cited

U.S. PATENT DOCUMENTS

| | | | |
|---|---|---|---|
| 3,428,973 | 2/1969 | Hargest et al. | 5/423 |
| 3,775,781 | 12/1973 | Bruno et al. | 5/61 |
| 3,866,606 | 2/1975 | Hargest | 128/71 |
| 3,879,776 | 4/1975 | Solen | 5/453 |
| 4,068,334 | 1/1978 | Randall | 5/453 |
| 4,193,149 | 3/1980 | Welch | 5/456 |
| 4,279,044 | 7/1981 | Douglas | 5/453 |
| 4,481,686 | 11/1984 | Lacoste | 5/453 |
| 4,483,029 | 11/1984 | Paul | 5/453 |
| 4,498,205 | 2/1985 | Hino | 5/449 |
| 4,542,547 | 9/1985 | Sato | 5/453 |
| 4,583,255 | 4/1986 | Nogaki | 5/453 |

FOREIGN PATENT DOCUMENTS

| | | | |
|---|---|---|---|
| 2816641 | 10/1978 | Fed. Rep. of Germany | 5/455 |
| 1456058 | 10/1966 | France | 5/453 |

*Primary Examiner*—John E. Murtagh
*Assistant Examiner*—Andrew Joseph Rudy
*Attorney, Agent, or Firm*—Dority & Manning

[57] ABSTRACT

A patient support structure that employs fluid pressure to fluidize granular material for patient support. Fluidizable granular material is received within the structure atop a fluid diffuser surface. Separate plenum chambers are located below the diffuser surface with each plenum chamber being associated with valved fluid manifolds. Operators are associated with the valves and a control system for sequential or otherwise opening and closing of the valves to permit controlled fluidization of the granular material over a selected portion of the diffuser surface according to a predetermined arrangement.

22 Claims, 7 Drawing Figures

FLUIDIZED PATIENT SUPPORT APPARATUS

BACKGROUND OF THE INVENTION

This invention relates to an improved fluidized patient support system that is of particular advantage to burn patients, as well as other patients who are immobilized for extended recuperative periods.

Historically, hospital beds for patients have in general been conventional where, though adjustable as to height and attitude a mattress-springs arrangement has been provided for receiving the patient thereon covered, of course, with appropriate bed clothing. Particular problems have developed in use of the conventional hospital beds where the patients, due to prolonged contact with the support surface in generally immobile conditions, have developed decubitus ulcers or bed sores, as a result of pressure points between the support surface and certain portions of the patient's body. Additionally, in the case of burn patients where the severity of the injury or wound is such that the patient is affected over a significant portion of his body, the conventional bed presents problems not only with the healing process due to contact between raw areas of the human body and the support, but also due to fluids exuding from the patient's body. In like fashion, other types of injuries and reasons for confinement have presented problems with the conventional hospital bed.

In order to obviate some of the problems inherent with the conventional hospital bed, fluidized patient support structures have been developed as exemplified in the Hargest et al. U.S. Pat. No. 3,428,973, in which a tank is provided, partially filled with a mass of granular material which is received atop a diffuser surface and is covered with a loose fitting flexible patient contact sheet or surface. Fluid, such as air, is forced through the diffuser surface and fluidizes the granular material, preferably ceramic spheres, with adequate force that a patient received on the flexible sheet is suspended on the fluidized bed. In this fashion, very gentle forces are imparted to the body portions of the patient, whereby the incidence of development of decubitus ulcers is reduced and whereby an individual experiencing trauma, such as produced by severe burns may rest comfortably.

A further fluidized patient support structure is disclosed in the Hargest U.S. Pat. No. 3,866,606 which structure has the same basic elements of that mentioned above with the addition of control means to cyclically fluidize the total mass of granular material, also preferably ceramic spheres, for floatation of the patient, whereby in a non-fluidized state, the patient settles into the mass of granular material which becomes a rigid body contoured structure against which the patient's body may be placed in traction. In like fashion, the cyclic effect of fluidizing-rigidifying the total mass of granular material permits variation in patient attitude, again towards the reduction of the incidence of development of decubitus ulcers. Still further, a similar structure is also shown in the Paul U.S. Pat. No. 4,483,029 in which a variable depth fluidized bed is provided.

In the fluidized patient support systems described above, all of which achieve their intended purpose, the fluidized bed is basically static even when the intermittent fluidization is achieved. In other words, the buoyant forces of the fluidized bed are normally vertical in support of the supine patient. One of the factors influencing the development of decubitus ulcers is the level of flow of blood throughout the patient's subcutaneous capillaries. Coupled with the pressure produced by conventional beds or supports, not only does the patient experience discomfort, but ulcers result.

The improved structure of the present invention will perform at efficacy levels equal to that of the presently commerical fluidized patient support systems. At the same time, structures according to the present invention afford greater patient comfort and improved blood circulation for a patient residing on the support structure. As such, the fluidized patient support structure of the present invention represents an improvement over known prior art structures.

SUMMARY OF THE INVENTION

It is an object of the present invention to provide an improved fluidized patient support system.

Yet another object of the present invention is to provide a fluidized patient support system that is flexible in design characteristics, is light, relatively inexpensive, and easy to maintain free of contamination.

Still further, another object of the present invention is to provide an improved fluidized patient support system, the fluidized mass portion for which may be manipulated to afford improved interaction with a patient's body.

Yet another object of the present invention is to provide an improved fluidized support system that induces improved blood circulation for a patient residing thereon.

Still another object of the present invention is to provide an improved fluidized patient support system that provides a wave motion of fluidizable granular material along an intended dimension of the system.

Generally speaking, the improved patient support structure according to teachings of the present invention comprises an open top container means; a mass of granular material received within said container; means for supporting said granular material within said container, said support means being porous to fluid passage and impervious to passage of granular materials; means for generating fluid pressure beneath said support means for fluidizing said granular material above said support means; means for directing at least a portion of said generated fluid pressure beneath predetermined portions only of said support means according to a predetermined arrangement for fluidizing granular material thereabove according to said predetermined arrangement; and flexible means enclosing said granular material for receipt of a patient thereon.

In a preferred embodiment, the improved patient support system according to teachings of the present invention comprises an open top container means; a mass of granular material received within said container; means for supporting said granular material within said container and being porous to fluid pressure; means for generating fluid pressure below said support means for fluidizing said granular material above said support means; a plurality of separate compartments located below said support means, each said compartment having valve means associated therewith for communication with said fluid pressure generating means when said valve is open, valve operator means for opening and closing said valves for fluidizing granular material over said compartments when said valves are open; means to selectively actuate said valve operator means according to a predetermined arrangement and flexible means enclosing said open top of said container, said enclosing means permitting passage of fluid through at least a portion of same while precluding passage of granular materials therethrough.

More specifically, a fluidized patient support system of the present invention comprises a tank having an open top into which a porous diffuser plate is placed, being located atop a support structure above a bottom wall of the tank. Separate compartments located below the diffuser plate define a plurality of plenum chambers therealong. A mass of granular materials, preferably ceramic spheres, is placed atop the diffuser plate with a flexible sheet draped across the top of the mass of granular material. An air compressor generates fluid pressure, which when directed into the individual plenum chambers, passes through the diffuser plate and fluidizes the granular material thereabove. The individual plenum chambers are preferably operatively associated with a common pressure manifold with valves located therealong to open or close communication between the individual plenum chambers and the common pressure manifold. Valve operator means are provided to selectively open and close the valves to the chambers with timing means actuating the valve generator means according to a predetermined sequence. Sequential opening and closing of the valves will produce segmented fluidization along the support structure producing a horizontally moving fluid wave which produces a generally vertical buoyant force on the patient along with a progressive change in capillary closing pressure which stimulates capillary blood flow.

Mechanically or electrically actuated valves may be employed in conjunction with the individual plenum chambers with correspondingly appropriate operators associated therewith. In like fashion, various types of timing means may be associated with the valve operators for actuation of same. A cam, or electrical contact for example, may move into and out of contact with an operator switch. Mechanical linkages may be employed for selective opening and closing of the valves. Likewise, for random, sequential or other valve operation, computer timing controls may be employed.

The improved fluidized patient support structure according to the present invention will not only afford proper patient support, but is also capable, as mentioned above, of generating a moving fluid wave along and/or across the structure. Hence, the patient may receive wave forces provided by area fluidization-defluidization of the granular material above the various plenum chambers.

DESCRIPTION OF A PREFERRED EMBODIMENT

Figure 1:
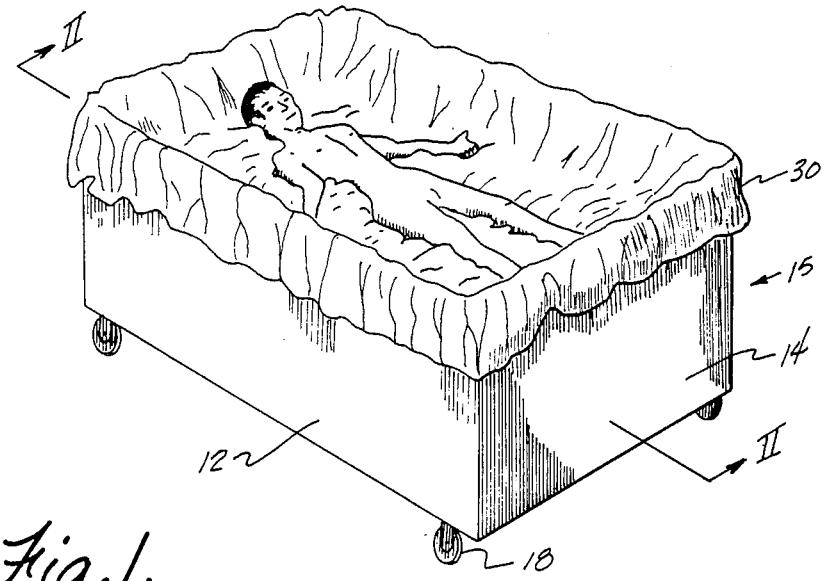
FIG. 1 is an isometric view of an improved patient support structure according to teachings of the present invention.
Figure 2:
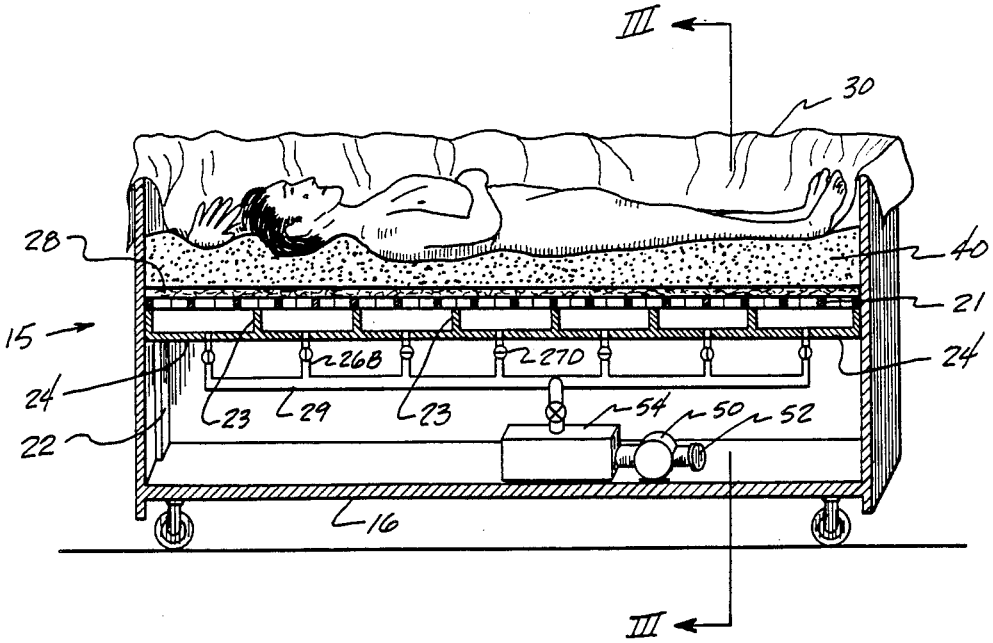
FIG. 2 is a vertical cross-sectional view of the patient support structure as illustrated in FIG. 1, taken along line II—II.
Figure 3:
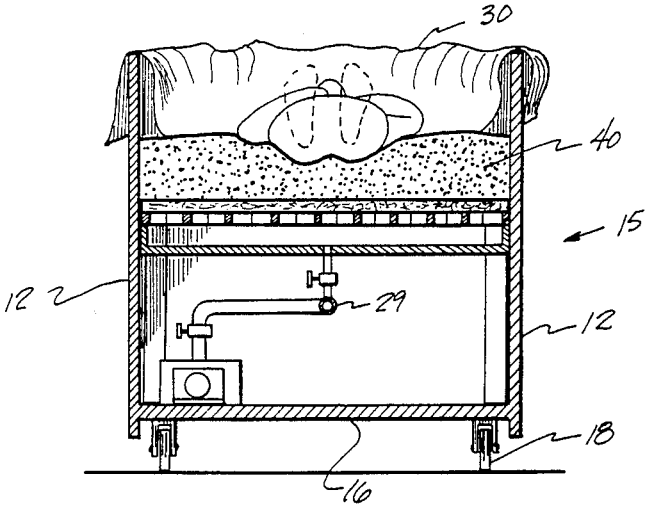
FIG. 3 is a vertical cross-sectional view of the patient support structure as shown in FIG. 1, taken along a line III—III of FIG. 2.

Making reference to the Figures, preferred embodiments of the present invention will now be described in detail. In FIGS. 1, 2 and 3, a patient support structure according to the teachings of the present invention is shown assembled in several views. The patient support structure includes vertical side walls 12 and vertical end walls 14 which combine with a bottom wall 16 to define an open top tank or container generally indicated as 15, which has a flexible sheet material 30 received across same, above a mass of granular material 40, and on which a patient directly resides. As illustrated in FIGS. 1, 2 and 3, the patient will generally settle to a certain depth within the bed of granular material when fluidized, with the flexible sheet 30 conforming to the body due to the fact that in those immediately adjacent areas where body contact is made, the fluidized bed extends to a higher elevation than beneath the body of the patient.

Structures according to the present invention may be manufactured in a truly mobile mode as indicated by the rollers or wheels 18 located beneath the tank. In this fashion, the structure is portable, may be rolled from one location to another, such as from a patient's room to an operative suite where a patient may be transferred from an operating table directly to the fluidized support structure and returned to the patient's room. The rollers 18 and associated framework are symbolic of means to movably support the instant fluidized support structure. Accordingly, though not illustrated, the movable support means may be such that once transportation of a patient is complete, rollers 18 may be immobilized by conventional means (not shown) to prevent inadvertent movement of the structure until next desired.

While the tank or container 15 of structures according to the present invention may be manufactured of any suitable material that will adequately support the patient and the weight of the pertinent structure, lightweight structural materials, such as reinforced fiberglass sheets, foamed polymeric sheets, or the like may be utilized to further reduce weight of the overall structure.

Making specific reference to FIGS. 2, 3 and 4, further details of a preferred embodiment of the patient support structure of the present invention will now be described in detail. A support element 21 is located within the confines of container 15 and is spaced apart from bottom wall 16 by vertical struts or legs 22. Support element 21 is preferably a skeletal framework that will not materially impede the passage of air therethrough, but will possess adequate strength to support the remaining materials and a patient thereabove. Located atop support element 21 is a diffuser plate or surface 28 which is pervious to fluid pressure and impervious to passage of granular material 40.

Figure 4:
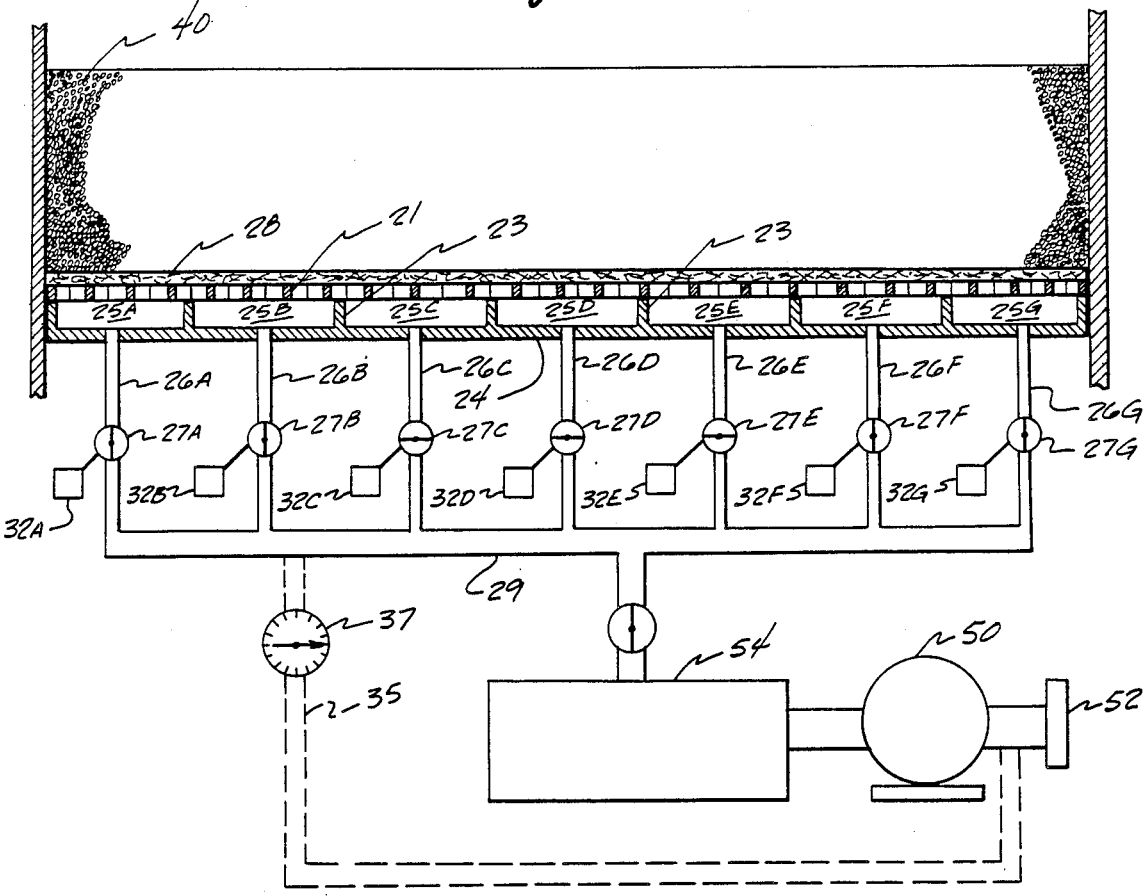
FIG. 4 is a side elevational view in partial cross-section of operative elements of a patient support structure according to teachings of the present invention.

As specifically illustrated in FIGS. 2, 3, and 4, support element 21 includes a plurality of vertical dividers 23 depending therefrom with a lower horizontal cover element 24 extending therebelow. Dividers 23 and lower cover 24 cooperate to define a plurality of separate plenum chambers 25A, 25B, 25C, 25D, 25E, 25F and 25G beneath diffuser plate 28. Each plenum chamber 25A, 25B, 25C, 25D, 25E, 25F and 25G has an individual fluid pressure conduit or manifold 26A, 26B, 26C, 26D, 26E, 26F and 26G, respectively, in communication therewith, each of which is provided with corresponding valve means 27A, 27B, 27C, 27D, 27E, 27F and 27G, respectively. Fluid pressure conduits 27A–G are in communication with a common fluid pressure manifold 29 which, in turn, communicates with a fluid pressure generator means 50.

Fluid pressure generator means 50 is preferably an air compressor which forces air under pressure into common manifold 29 and thence into individual fluid conduits 26A–G. In those individual fluid conduits 26A–G in which the respective valve 27 is open, fluid pressure will be provided in the corresponding plenum chamber 25 and will fluidize granular material 40 thereover. If desired, fluid pressure generator means 50 may also include a filter means 52, a heat exchanger 54, or the like in conjunction therewith for appropriate pre-conditioning of the fluidizing medium for therapeutic and/or patient comfort benefits. While shown within tank 15 in the Figures, fluid pressure generator means 50 could likewise be located outside tank 15.

With plenum chamber valves 27A–G operable between open and closed positions, fluid pressure in the individual plenum chambers 25A–G is controlled thereby. Each valve 27A–G is provided with a valve operator means 32A–G (See FIGS. 5 and 6) operatively associated with valves 27A–G and with a control means 60 for actuation of the operator means. The various valves 27A–G may thus be operated according to a prearranged sequence. Sequential opening of valves 27A through 27G will cause separate fluidization of granular material 40 above individual plenum chambers 25A through 25G whereby a forward moving wave motion will be generated along the length of container 15. Such action may include closing of a preceding valve as a next valve is being opened or permitting prior opened valves to remain open. The wave motion produced varies the forces on the body of a patient residing atop the structure and stimulates capillary blood flow. In like fashion, all of valves 27A–G may be maintained open for total fluidizing of mass 40.

Figure 5:
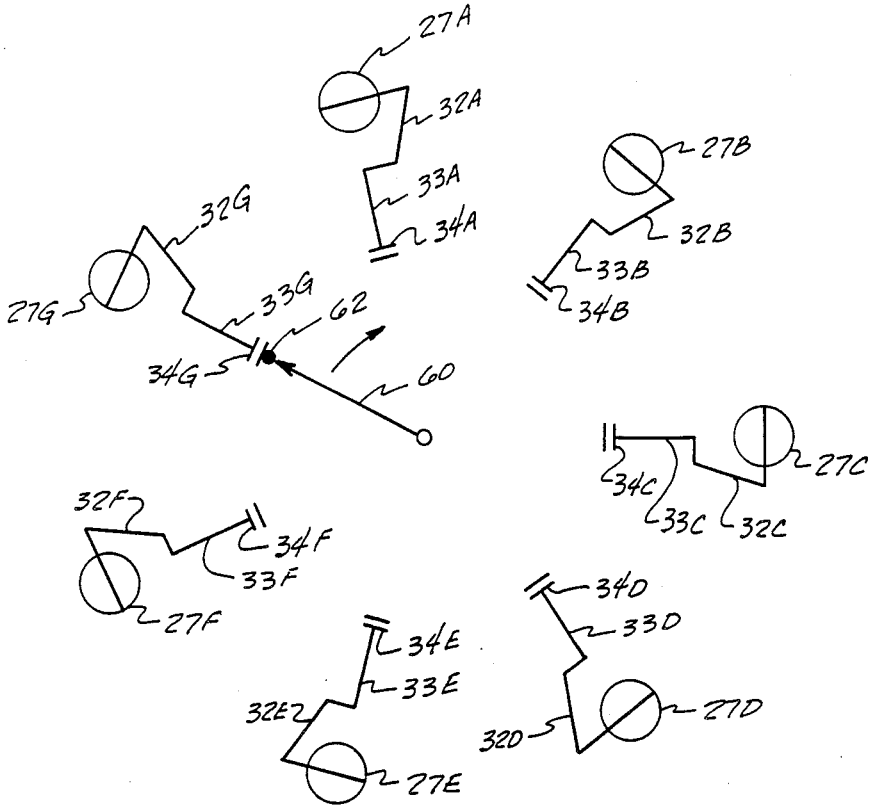
FIG. 5 is a schematic view of an arrangement for timed selective actuation of plenum chamber valves according to the present invention.

FIG. 5 is a schematic illustration of one embodiment of a system for sequential operation of valves 27A–27G that provide communication between fluid pressure generating means 50 and plenum chambers 25A–25G, respectively. Electrical valve operators 32A–G are schematically illustrated as associated with the respective valves 27A–G and having electrical leads 33A–G and contacts 34A–G respectively. A timing or control means 60 is provided, and is equipped with an electrical contact 62. Rotation of control means 60 brings contact 62 into engagement with operator contacts 34A–34G which creates a particular timed sequence. When contact is made with an individual operator contact 34, the respective operator 32 is actuated to open its respective valve 27, permitting fluid pressure into the respective plenum chamber 25 to fluidize the granular material 40 above same. In like fashion, as control means 60 moves away from the operator contact 34, the particular operator 32 is deactuated to cause its respective valve 27 to close. With the arrangement discussed with respect to FIG. 5, it may thus be seen that the various plenum chambers may be sequentially fluidized and defluidized along or across container 15. A moving wave action of fluidized granular material 40 is thus produced to aid capillary blood flow as described above.

Figure 6:
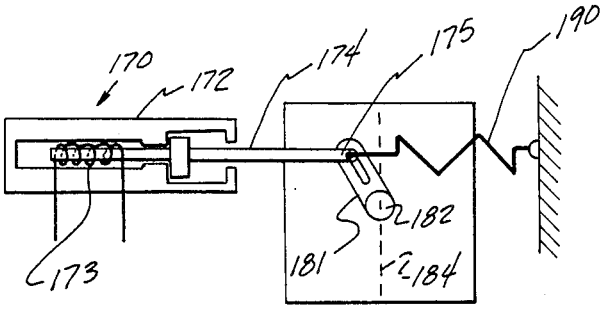
FIG. 6 is a further schematic view of an actuator arrangement for plenum chamber valves according to the present invention.

A specific embodiment of a valve operator 32 is illustrated in FIG. 6 in the form of a solenoid generally 170. Solenoid 170 includes a housing 172 through which a rod 174 extends. Rod 174 is connected at an outer free end 175 to linkage 181 that is, in turn, secured to a shaft 182 to which a valve plate 184 is connected. A spring 190 is also secured to rod end 175 and biases valve plate 184 in the closed position when solenoid 170 is not energized. As illustrated, an electromagnet 173 is provided within solenoid body 172 with a portion of rod 174 extending therewithin. Energization of electromagnet 173 pulls rod 174 therealong (as illustrated) whereby valve linkage 181 rotates shaft 182 and moves valve plate 184 to the open position. Upon removal of current from electromagnet 173, spring 190 returns valve plate 184 to the closed position. In a further embodiment (not shown), the valves to the individual plenum chambers may be normally biased open to afford a totally fluidized mass 40 and selectively closed if desired.

Figure 7:
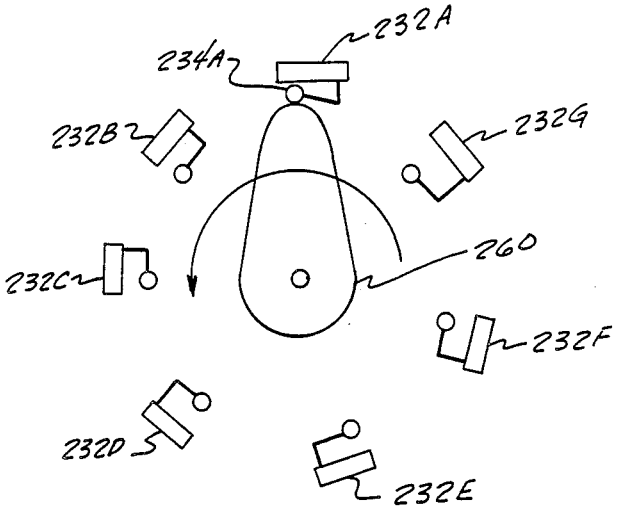
FIG. 7 is a further schematic view of a further arrangement for timed actuation of plenum chamber valves according to the present invention.

Control means 60 has been illustrated in FIG. 5, schematically as a moveable electrical contact. Many different arrangements are available, however. By way of example, referring to FIG. 7, a cam 260 or other mechanical linkage arrangement may be provided to selectively actuate the various valve operators. Particularly in FIG. 7, cam 260 rotates into and out of actuating contact with valve operators 232A–G. As illustrated, cam 260 has biased a contact 234A of valve operator 232A into a position to electrically actuate operator 232A whereby the corresponding valve (not shown) would be opened or closed, depending on the arrangement. Movement of cam 260 away from contact 234A permits return of contact 234A to an open position and deactuates operator 232A. In like fashion, a microprocessor may be utilized for control of the valve operators. In sum, with the various available arrangements, the patient support structure of the present invention may be selectively operated as a standard fluidized bed (all valves open); an intermittently fluidized bed (all valves open and close simultaneously, or intermittent operation of the fluid pressure generating means with all valves open), or intermittent operation of the individual plenum chambers according to a predetermined sequence.

FIG. 4 also illustrates a fluid medium by-pass line 35 (in phantom) with a valve 37 located therein. Should pressure generator means 50 be operating at a level for total fluidization, closure of the individual plenum chamber valves will divert the full fluid pressure to the remaining chambers, possibly resulting in excess fluidization. By-pass valve 37 is provided to avoid the excess fluidization problem. Particularly, valve 37 can be preset to open at a predetermined pressure and recycle a portion of the fluid to generator means 50. Consequently the fluid pressure in the chambers can be maintained at an appropriate level.

It will be understood, of course, that while the form of the invention herein shown and described constitutes a preferred embodiment of the invention, it is not intended to illustrate all possible form of the invention. It will also be understood that the words used are words of description rather than of limitation and that various changes may be made without departing from the spirit and scope of the invention herein disclosed.

What is claimed is:

1. An improved patient support structure comprising:
(a) an open top container means;
(b) a mass of granular material received within said container means;
(c) means for supporting said granular material within said container means, said support means being porous to fluid pressure and impervious to passage of granular material;
(d) means for generating fluid pressure beneath said support means for fluidizing said granular material above said support means;
(e) means for sequentially directing at least a portion of said fluid under pressure, said means for sequentially directing being located beneath predetermined portions of said support means for fluidizing granular material thereabove; and
(f) flexible means atop said granular material for receipt of a patient thereon.

2. A patient support structure as defined in claim 1 wherein said means for sequentially directing said fluid under pressure comprises a plurality of separate compartments located beneath said support means, each said compartment having valve means associated therewith for communication with said fluid pressure generating means when open, and valve operator means for sequentially opening and closing said valves according to a predetermined arrangement.

3. A patient support structure as defined in claim 2 wherein said valve operator means comprise a a solenoid operatively associated with each said valve, and control means operatively associated with said solenoids for selectively actuating and deactuating same according to said predetermined arrangement.

4. A patient support structure as defined in claim 3 wherein said control means comprises cam means having solenoid actuator means located thereon so that said solenoids are sequentially actuated and deactuated.

5. A patient support structure as defined in claim 1 wherein said granular material is ceramic spheres.

6. A patient support structure as defined in claim 2 wherein said fluid pressure generating means comprises an air compressor, and a fluid manifold connected between said compressor and said separate compartments.

7. A patient support structure as defined in claim 6 comprising further a by-pass fluid manifold means to permit fluid escape at predetermined fluid pressure levels.

8. An improved patient support structure comprising:
(a) an open top container means;
(b) a support means located within said container means and defining a plurality of separate plenum chambers therealong;
(c) fluid diffuser means located atop said support means;
(d) a mass of granular material received within said container means atop said diffuser means;
(e) means for pressurizing fluid and introducing said fluid under pressure into said separate plenum chambers according to a predetermined arrangement; and
(f) flexible sheet means located above said granular material for receipt of a patient thereon.

9. A patient support structure as defined in claim 8 wherein said container means includes a bottom wall, side walls and an end wall.

10. A patient support structure as defined in claim 9 wherein said support means comprises a skeletal top surface with said plenum chambers being located below said skeletal surface and said fluid diffuser means being located atop said skeletal surface.

11. A patient support surface as defined in claim 8 wherein said means for pressurizing a fluid and sequentially introducing same to said plenum chambers comprises an air compressor, a main fluid manifold in operative association with said compressor and individual conduits connected between said main manifold and each said plenum chamber, said individual conduits having valves therein operable between an open and a closed position.

12. A patient support structure as defined in claim 11 further comprising operator means associated with said valves and control means operatively associated with said valve operator means to sequentially actuate and deactivate said operator means according to said predetermined arrangement.

13. A patient support structure as defined in claim 12 wherein said operator means are electrical solenoids.

14. A patient support structure as defined in claim 13 wherein said control means for said solenoids comprises timing means having at least one electrical contact that is moveable into and out of actuating contact with said solenoids.

15. A patient support structure as defined in claim 13 wherein said control means for said solenoids is a cam.

16. A patient support structure as defined in claim 13 wherein said valves are normally biased towards an open or closed position and said solenoids when actuated overcome said bias and move said valve to an opposite position.

17. An improved patient support structure comprising:
(a) an open top container, said container having side walls, end walls, and a bottom wall;
(b) support means located within said container, said support means defining a plurality of separate open top plenum chambers therealong, each of said plenum chambers having a fluid manifold in communication therewith, each said fluid manifold having valve means associated therewith;
(c) fluid diffuser means located atop said support means;
(d) a mass of granular material received atop said fluid diffuser means;
(e) fluid pressurizing means in communication with said plenum chamber fluid manifolds for introducing fluid under pressure thereto;
(f) means for sequentially operating said fluid manifold valve means according to a predetermined arrangement so that fluid under pressure is supplied to each plenum chamber when the valve means therefor is open and fluidizes granular material thereabove and is precluded from introduction to each plenum chamber where the valve means therefor is closed; and
(g) flexible sheet means received atop said granular material for receipt of a patient thereon.

18. A patient support structure as defined in claim 17 wherein said fluid pressurizing means comprises an air compressor and a main fluid manifold connected between said compressor and said plenum chamber manifolds.

19. A patient support structure as defined in claim 18 wherein said valve operating means comprises an operator for each valve and operator control means.

20. A patient support structure as defined in claim 19 whwerein said valve operators are electrical solenoids and said control means sequentially electrically actuates and deactuates said solenoids according to said predetermined arrangement.

21. A patient support structure as defined in claim 20 wherein said valves are sequentially opened and closed along said structure.

22. A patient support structure as defined in claim 20 wherein said control means is timing means, said timing means being rotatable into and out of actuating contact with electrical contacts for said solenoids.

* * * * *